US008869985B2

(12) United States Patent
Schick

(10) Patent No.: US 8,869,985 B2
(45) Date of Patent: Oct. 28, 2014

(54) PACKAGING CONTAINER

(75) Inventor: Werner Schick, Neuenkirchen (DE)

(73) Assignee: Pöppelmann Holding GmbH, Lohne (DE)

( * ) Notice: Subject to any disclaimer, the term of this patent is extended or adjusted under 35 U.S.C. 154(b) by 83 days.

(21) Appl. No.: 13/468,657

(22) Filed: May 10, 2012

(65) Prior Publication Data

US 2012/0285953 A1 Nov. 15, 2012

(30) Foreign Application Priority Data

May 11, 2011 (DE) ..... 20 2011 100 541 U

(51) Int. Cl.

| | |
|---|---|
| ***B65D 17/34*** | (2006.01) |
| ***B65D 21/02*** | (2006.01) |
| ***B65D 43/02*** | (2006.01) |
| *B65D 21/00* | (2006.01) |

(52) U.S. Cl.

CPC .. *B65D 43/0237* (2013.01); *B65D 2543/00629* (2013.01); *B65D 2543/00027* (2013.01); *B65D 2543/00685* (2013.01); *B65D 2543/00296* (2013.01); *B65D 2543/00833* (2013.01); *B65D 2543/00555* (2013.01); *B65D 2543/00092* (2013.01); *B65D 21/0233* (2013.01)

USPC ..... 206/519; 220/270; 220/606

(58) Field of Classification Search

USPC ..... 220/270, 269, 781, 606; 206/506, 507, 206/519, 515, 508

See application file for complete search history.

(56) References Cited

U.S. PATENT DOCUMENTS

| | | | | | |
|---|---|---|---|---|---|
| 3,409,167 | A * | 11/1968 | Blanchard | 220/609 |
| 4,687,117 | A * | 8/1987 | Terauds | 220/781 |
| 4,705,172 | A * | 11/1987 | Gage | 206/519 |
| 4,826,039 | A * | 5/1989 | Landis | 220/380 |
| 5,460,286 | A * | 10/1995 | Rush et al. | 220/782 |
| 8,191,728 | B2 * | 6/2012 | Auer et al. | 220/784 |
| 8,210,391 | B2 * | 7/2012 | Luburic | 220/635 |
| 2003/0071043 | A1 * | 4/2003 | Davis | 220/276 |
| 2006/0070908 | A1 * | 4/2006 | Raymundo et al. | 206/515 |
| 2006/0180491 | A1 * | 8/2006 | Zephir et al. | 206/507 |
| 2006/0278553 | A1 * | 12/2006 | Diamond | 206/515 |
| 2008/0099481 | A1 * | 5/2008 | D'Amato | 220/276 |
| 2010/0108556 | A1 * | 5/2010 | Claffy | 206/508 |

* cited by examiner

*Primary Examiner* — Mickey Yu
*Assistant Examiner* — Niki Eloshway
(74) *Attorney, Agent, or Firm* — Husch Blackwell LLP

(57) ABSTRACT

A packaging container has a lid (2) and a container (1) for keeping preferably hot, fillable foods, in particular food packaging made of plastic, having a tamper-evident closure, situated on a skirt (3) which extends next to a side wall (12), and which has a tamper-evident tab (6). The container (1) has a holding space which is delimited by the side wall (12), and the lid (2) which is designed as a clamp-on lid or snap-on lid being fixable at the top container edge, and the container (1) has an anti-twist lock (13) such that a plurality of the containers (1) may be fixed in a stack in the peripheral position before filling. At least one anti-twist lock (13) of the container (1) is formed by an offset which tapers downwardly in a side wall (12) in the direction of a contact surface (19), and which has two contact edges (35) in the circumferential direction.

17 Claims, 9 Drawing Sheets

PACKAGING CONTAINER

CROSS-REFERENCE TO RELATED APPLICATIONS

This application claims priority to German Patent application No. DE 202011100541.4 filed on May 11, 2011.

BACKGROUND

The present invention relates to a packaging container comprising a lid and a container, to be covered by the lid, for keeping preferably hot, finable foods, in particular food packaging made of plastic, preferably having a tamper-evident closure, situated on a skirt which extends next to a side wall, and which includes at least one tamper-evident tab, the container having a holding space which is delimited by the side wall, and the lid which is designed as a clamp-on lid or snap-on lid being fixable at the top container edge, and the container having an anti-twist lock such that a plurality of the containers may be fixed in a stack in the peripheral position before filling.

Known commercially available packaging containers have anti-twist locks which are designed in the form of vertically oriented webs or ribs which form stops together with further webs located in the circumferential direction in the container base. The stop prevents the container, which in particular is designed as a round pail, from rotating in a stack. A disadvantage of the ribs or webs is that they must be small in order to avoid edges which interfere with handling and are sometimes sharp. As the result of increasingly larger forces which act on the containers due to ever longer cycle times during production, the ribs and webs often do not have sufficient stability. This has necessitated an alternative design of anti-twist locks.

SUMMARY OF THE INVENTION

The object of the present invention, therefore, is to refine the subject matter of the preamble according to claim 1 in such a way that an exact alignment of the lid and the container is ensured for the filling process, and the filling process is made safer with regard to handling the containers.

The object is achieved by, a packaging container for keeping hot, fillable foods, in particular food packaging made of plastic, comprising: a lid; a container; a tamper-evident closure, situated on a skirt which extends next to a side wall; a tamper-evident tab; the container having a holding space which is delimited by the side wall the lid having a snap-on element being fixable at the top container edge; the container having an anti-twist lock such that a plurality of the containers may be fixed in a stack in the peripheral position before filling; the at least one anti-twist lock of the container being formed by an offset which tapers downwardly in a side wall in the direction of a contact surface; and the lock having two contact edges in the circumferential direction and the filling per se is also made safer by the packaging container, wherein the contact elements in a top view may have a substantially circular circumferential design.

Further advantageous embodiments of the invention result from the subclaims which refer to these claims, and the following description.

According to the invention, it is provided that the at least one anti-twist lock of the container is formed by an offset which tapers downwardly in a side wall in the direction of a contact surface, and which has two contact edges in the circumferential direction. As the result of thus dispensing with rib-like anti-twist locks, the containers, designed in particular as a round pail which have an essentially circular shape viewed from the top, are better protected against twisting in a stack, compared to known containers.

An offset, which may be designed as an indentation in, or a protrusion, from the side wall is more stable, and preferably is situated in the upper container region, i.e., in the upper third of the container. At that location, the container already has a particularly stable design in the edge region, so that the pails do not twist relative to one another in a stack, even under fairly high forces. As the result of inwardly or outwardly provided offsets, nesting of the containers is not impaired for conically or downwardly tapering containers.

A container according to the invention preferably comprises a storage container which includes two anti-twist locks located on the peripheral side, in particular on opposite sides, and therefore is doubly secured.

The anti-twist lock of a packaging container according to the invention is preferably formed by a protrusion from the side wall; i.e., an outer side of the part of the container forming the anti-twist lock is located a farther distance from a longitudinal center axis of the container than a portion of the side wall surrounding the anti-twist lock. In this regard, it is advantageous that at the same time the container interior is enlarged.

The anti-twist lock may taper upwardly into an outwardly flared region of the side wall, so that on the one hand a harmonious transition is established in the upper edge region, and on the other hand additional space is provided in the upper container region. At the same time, the upwardly flared edge may be used for stacking the container. The stack height may be reduced by such an enlargement, which may result in a lower design of the anti-twist lock, viewed in a direction that is vertical with respect to the lower contact surface. Stacking or nesting is preferably carried out by means of webs or ribs of the next container which are supported on an upper sealing edge.

At the same time, the upward tapering of the anti-twist lock into the flared region ensures that on the inner side of the side wall a line, representing the interior contact area of a clamp-on lid, exists which extends at a level above the anti-twist lock. Thus, the seal-tightness of the container is not impaired by areas facing the outside.

The anti-twist lock preferably does not taper to a point at its lower end, but instead forms a shoulder having an edge that extends parallel to a lower contact plane. This edge may optionally be used as a stacking edge. Thus, in conjunction with another stacking edge or as a substitute for same, placement in a stack before filling is simplified.

In one design of the container, in particular as a round pail having a handle which is fastened to two handle joints, the anti-twist lock, viewed in the circumferential direction, is advantageously situated next to a handle joint. Force effects acting on the container by the handle during stacking in a stack may thus be directly compensated for without resulting in an action of force which is transmitted along the periphery. In addition, the anti-twist lock may thus be partially concealed.

In particular, a packaging container according to the invention comprises a storage container which has at least two anti-twist locks on opposite sides.

The outer side of the anti-twist lock may be provided toward the top, parallel to a side wall of the remaining container which borders a truncated cone.

The lid advantageously also has an anti-twist lock on the lid side, such that a plurality of lids in the stack may be fixed in the peripheral position before filling, thus improving the alignment of the lid and the container.

The anti-twist lock on the lid side is preferably formed by a region, located in the outer edge of the container and offset upwardly with respect to the rest of the outer edge, having locking edges on the side. The region is preferably likewise displaced, i.e., flared, outwardly, and may also be used as a fixing aid or for positioning rods situated at the side of the stack.

Locking edges of the anti-twist lock on the lid side are in particular angled relative to one another, as viewed from the front, and the anti-twist lock on the lid side has upper and lower contact edges whose vertical spacing from one another in particular corresponds to a stacking height of the lid. Nesting during stacking of the lids of the containers is therefore not hindered. In a stacked position, the locking or contact edges of the lids lock together.

The anti-twist lock of the lid, which in particular is designed as a clamp-on or snap-on lid, in particular has a gripping lug which, in a closed position of the container or storage container, may be covered by a tamper-evident tab of the tamper-evident closure after filling and before the first opening by a user. This lug, which is externally located with respect to the remaining lid edge, is used to facilitate removing the lid from the container, and at the same time, for positioning and aligning the lid stack before filling. The overall alignment of the packaging container, comprising a storage container and a lid, and including any label to be applied or affixed, is thus improved. Any labels to be provided on the container may be better positioned.

The tamper-evident tab, which may be joined to its border via at least one predetermined breaking point projection, is preferably centrally located on the peripheral side between two anti-twist locks. The coordinated placement of labels is simplified by such a symmetrical exterior of the packaging container.

The lid of a container according to the invention preferably has a protuberance or protrusion, situated in the lid surface, which is used as a positioning aid for a label to be placed on a lid surface, and thus improves the alignment of same with respect to the container and the lid. Such a protrusion may be, for example, a region of the inner lid edge which engages with an asymmetry of an otherwise circular label.

The protrusion, viewed along the periphery, is preferably situated next to the gripping lug, so that the alignment of the individual parts of the packaging container is improved, in particular in combination with a symmetrical tamper-evident tab that is situated between two anti-twist locks.

The filling of a packaging container according to the invention or of a storage container according to the preamble of claim 1 is improved in particular for hot finable foods having temperatures above 40°, preferably up to at least 100°, when the preferably closed container base, viewed in the radial direction from a longitudinal center axis toward the outside, has at least two contact elements which are separated by an elevated region that is raised relative to the lower contact surface. These contact elements do not have to have a completely peripheral design; rather, when provided at regular intervals in the circumferential direction they ensure a secure standing position of the container. On the one hand, the contact elements provide a stable upright position of the container, and on the other hand the wave-shaped design, for example, of the base profile in a vertical section results in increased elasticity in the base profile. The inward or outward motion of the container base, which may result from filling with hot or cold foods and the accompanying material changes during filling, may be improved. The base surface may in particular be moved or expanded outwardly or inwardly, for example toward the geometric center point of the container. As a result of the material which is additionally introduced into the container base due to the elevated region, movements of the container base during hot filling of the container according to the invention do not directly affect the side wall, which otherwise would be exposed to slight fluctuations due to filling with heated material.

Optimal adaptability while at the same time ensuring a stable base is achieved when the two contact surfaces are rings in the container base which in a top view are circular, i.e., extend parallel to the outer side wall. These contact surfaces are at least essentially wave-shaped in the vertical section, and make a transition from lower, rounded contact regions to a center, likewise rounded elevated region.

The inner contact element preferably makes a transition, preferably toward the center, to a plateau having only a slight ascending slope, or to a lid surface, ascending toward the center, in which in particular an in-mold label may be introduced.

It has been determined based on numerous tests that for filling with hot foods between 50° C. and 90° C., it is sufficient if contact elements are situated only in the outer edge region of a base, and, viewed from the top, the contact surface and the elevated region cover less than one-half the surface area of the container base. For an arrangement of the waves facing the side edge, a sufficiently large in-mold label may then be positioned toward the inside.

The profiling of the bottom side may likewise be used for providing anti-twist locks, in which case downwardly tapering regions which are delimited in the circumferential direction are situated in the base.

The upper and in particular sealable container edge together with the adjoining side wall and the outer skirt preferably have an n-shaped profile, whereby the two legs of the n-shaped profile may be connected to one another via support ribs. Such a pail having both a snap-on lid and a clamp-on lid may be provided, in particular having a widening of the holding space in the upper region of the side wall, the edge which is hot-sealable with a film having a width of at least 2 mm, preferably 2.5 mm to 3.5 mm. The container according to the invention may thus be multifunctional by being provided with both a clamp-on lid and a snap-on lid, the upper edge region including appropriate reinforcing ribs in a sufficient quantity, which, however, may be shorter in the region of a tamper-evident tab which may be present.

A tamper-evident tab is preferably externally attached to the n-shaped profile so that, viewed in a vertical section, the container edge in the region of the tamper-evident closure has a structure that is comparatively complex but very stable, having three walls (tamper-evident tab, two legs of the n-shaped profile).

The tamper-evident tab is delimited on the sides by two edge tabs, pointing upwardly from the remaining outer edge of the container, which are located farther out, relative to a longitudinal center axis of the container, than the adjacent regions of the tamper-evident tab, which are thus additionally protected. These two edge tabs may likewise be used as anti-twist protection, stacking aids, or centering aids, and thus are likewise used for aligning the container and lid with one another.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further advantages and particulars of the invention are provided in the description of the figures below. The schematic illustrations of the figures show the following.

DETAILED DESCRIPTION

Figure 1:
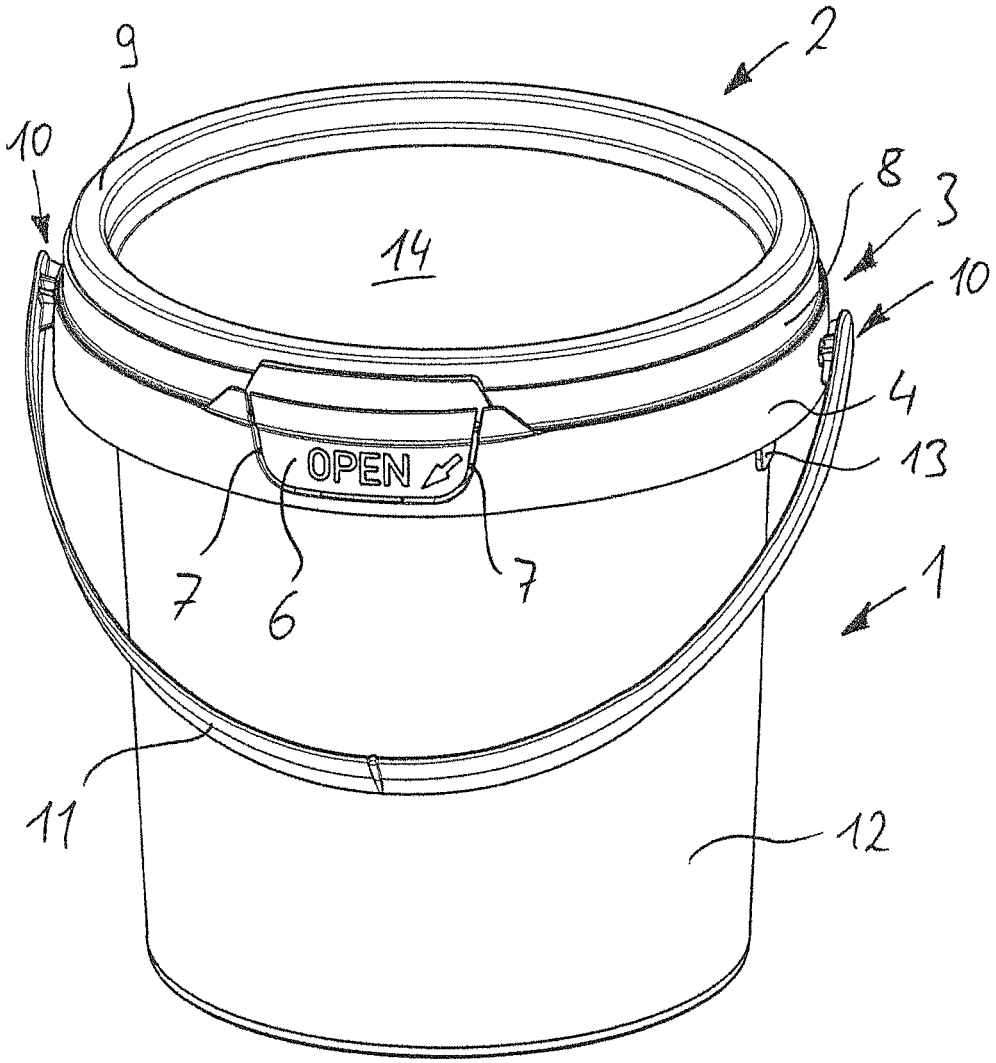
FIG. 1 shows a perspective view of the subject matter according to the invention.

Parts having identical or similar functions are provided with the same reference numerals if this is useful. Individual technical features of the exemplary embodiments described below may also result in refinements according to the invention, using the features of the previously described exemplary embodiments.

According to FIG. 1, the subject matter according to the invention comprises a container 1 having a lid 2. The container 1 is usable for keeping hot, fillable foods such as red fruit pudding, for example. At an upper container edge and running around same, a skirt 3 is provided which is formed by a lower skirt region 4 and an upper skirt region, not visible in greater detail in the figure. Situated at the lower skirt region 4 is a tamper-evident closure having a tamper-evident tab 6, which via predetermined breaking point projections 7 is joined to the region of the skirt 4 which it borders. In FIG. 1 the tamper-evident tab 6 conceals a gripping lug of the lid 2.

The lid 2 includes an outer edge region 8 by means of which the lid is clamped onto the upper skirt region of the container 1. Since the container 1 at the same time also has an upper container edge 26 which is usable as a sealing edge, the lid 2, designed as a clamp-on lid, is provided with a correspondingly wide upper edge 9. The lid may be carried by a handle 11.

The container 1 has a holding space, delimited by a side wall 12, which merges into a base, not visible in greater detail. In addition, the container, viewed in the circumferential direction, has two anti-twist locks 13 at the level of the handle joints 10, one of which is visible in FIG. 1. The anti-Mist locks are offsets of the side wall 12, which in each case taper downwardly in the side wall 12 of the container 1 in the direction of a contact surface, and have two contact edges.

An in-mold label may be provided in a lid surface 14 or also in the side wall 12, or a label may be affixed to the lid surface 14 or the side wall 12.

The anti-twist locks 13 (discernible in FIG. 2) are offset outwardly with respect to an outer edge contour 16 of the remaining container side wall 12, facing away from a longitudinal center axis 17 lying in the section plane A-A. The anti-twist locks 13 are formed by protrusions. A portion of a circular contact element 18 which forms a contact surface is discernible in the base region of the container shown in FIG. 2. Another circular contact element, which is offset inwardly with respect to the longitudinal center axis 17 and not visible in the figure, is also present.

Figure 2:
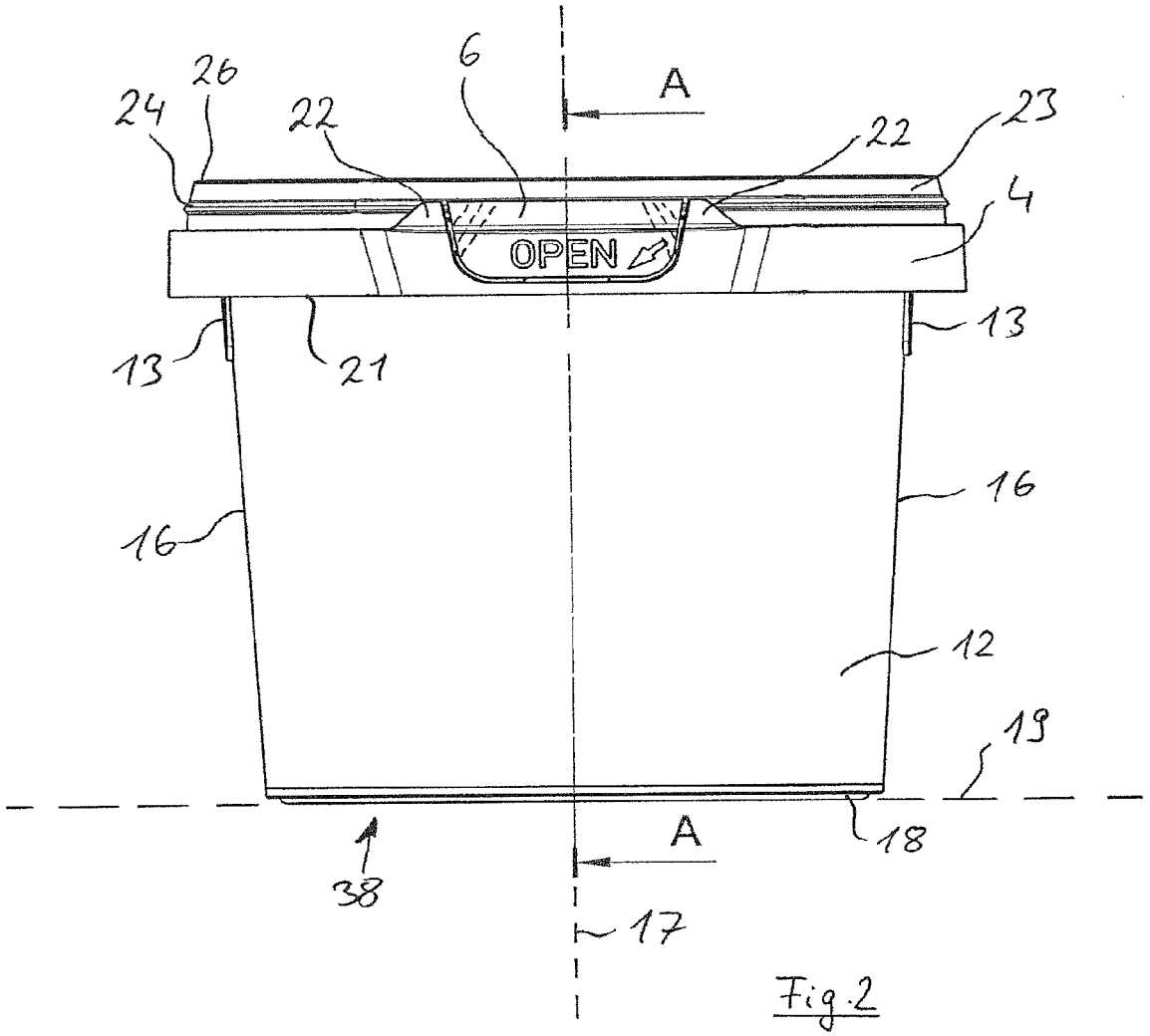
FIG. 2 shows a partial front view of the subject matter according to FIG. 1.

The bottom side of the contact element 18 lies in a contact surface 19 which projects perpendicularly from the plane of the drawing in FIG. 2.

The lower skirt region 4 has a lower edge 21, extending at an elevation, by means of which the container 1 may be supported on a corresponding insert in a filling system. The lower skirt region 4 is also provided with two edge tabs 22 which project outwardly from the longitudinal center axis 17, and which therefore protect the edge regions of the tamper-evident tab 6, recessed further inside, denoted by crosshatch. However, it is not necessarily preferred for a skirt region to hang downwardly; it may also extend upwardly from its connection to the next container.

Figure 3:
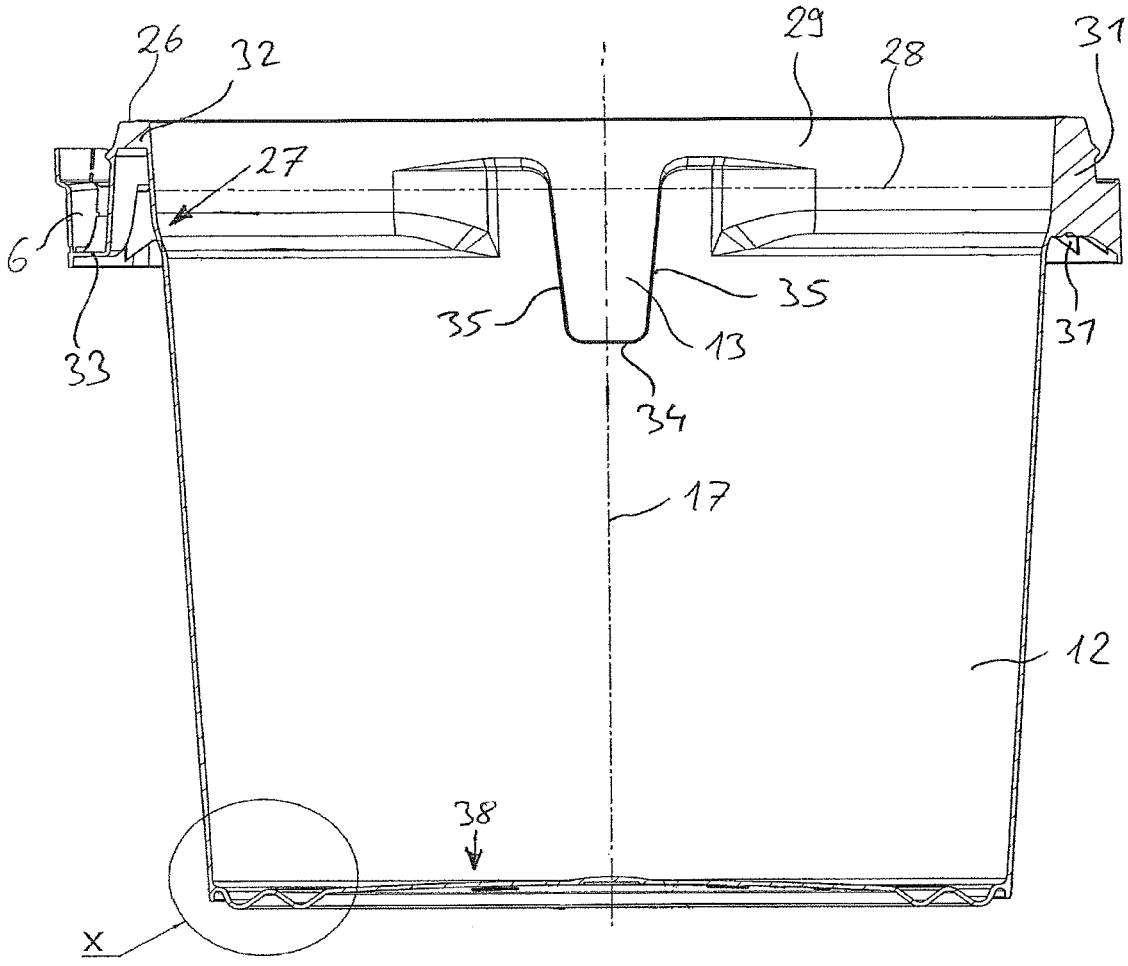
FIG. 3 shows the subject matter along A-A according to FIG. 2.

An upper skirt region 23 is provided for mounting a clamp-on lid having a clamping profile 24, and on the top side merges into a sealing edge 26 (see FIG. 3).

The sectional illustration according to FIG. 3 shows, among other things, an inner view of the side wall 12. The side wall is flared outwardly in a region 27, so that the anti-twist lock 13 tapers toward the topmost region 29 of the inner side wall 12 separated by the line 28. A line, not illustrated in greater detail, on which a clamp-on lid may be supported extends in this region.

The approximately n-shaped profile in the upper region of the container according to FIG. 12 is formed by the portion 29 of the side wall 12 which represents an inner leg, the two skirt regions 4 and 23 as an outer leg, and the sealing edge 26. The upper portion 29 of the side wall 12 and the outer leg of the profile are stabilized via webs 31 and 32. The webs 32 in the region of the tamper-evident tab are slightly smaller than the webs 31. Notwithstanding, the upper sealing edge, which is approximately 3 mm wide, is provided with a wall thickness of approximately 0.6 mm.

A shoulder 33 parallel to a lower contact surface 19 is used to attach the tamper-evident tab 6, which is thus offset further with respect to the outer leg of the profile (FIG. 3).

The anti-twist lock 13 forms a shoulder or bend at its lower end which has an edge 34 that is parallel to the lower contact plane 19. The anti-twist lock 13 includes two contact edges 35 in the circumferential direction which taper toward one another in the direction of the lower contact surface 19, i.e., downwardly and in the projection of the illustration in FIG. 3.

Figure 4:
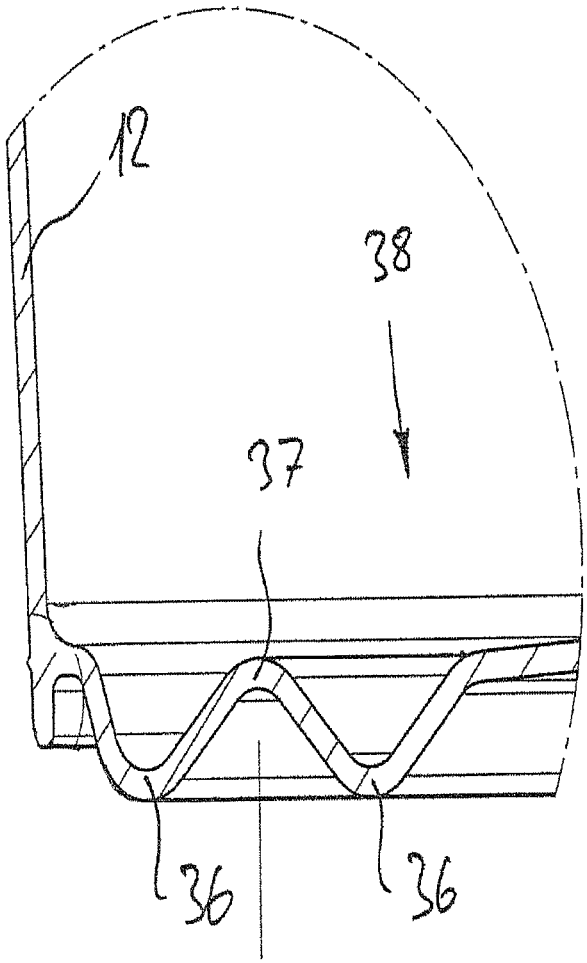
FIG. 4 shows detail X according to FIG. 3.

According to FIG. 4, the subject matter according to the preamble of claim 1 may have two contact elements 36 which are separated from one another by an elevated region 37. Regions 36 and 37 together have an approximate wave shape, which in the present case, however, does not involve precise cosine or sinusoidal waves, for example. Instead, the lower rounded regions 36 and the upper, likewise rounded region 37 are separated from one another by sections having a linear cross section. As a result of the additional material thus in the outer edge region of the base 38, the base may be expanded upwardly or downwardly without effects on the wall 12.

Figure 5:
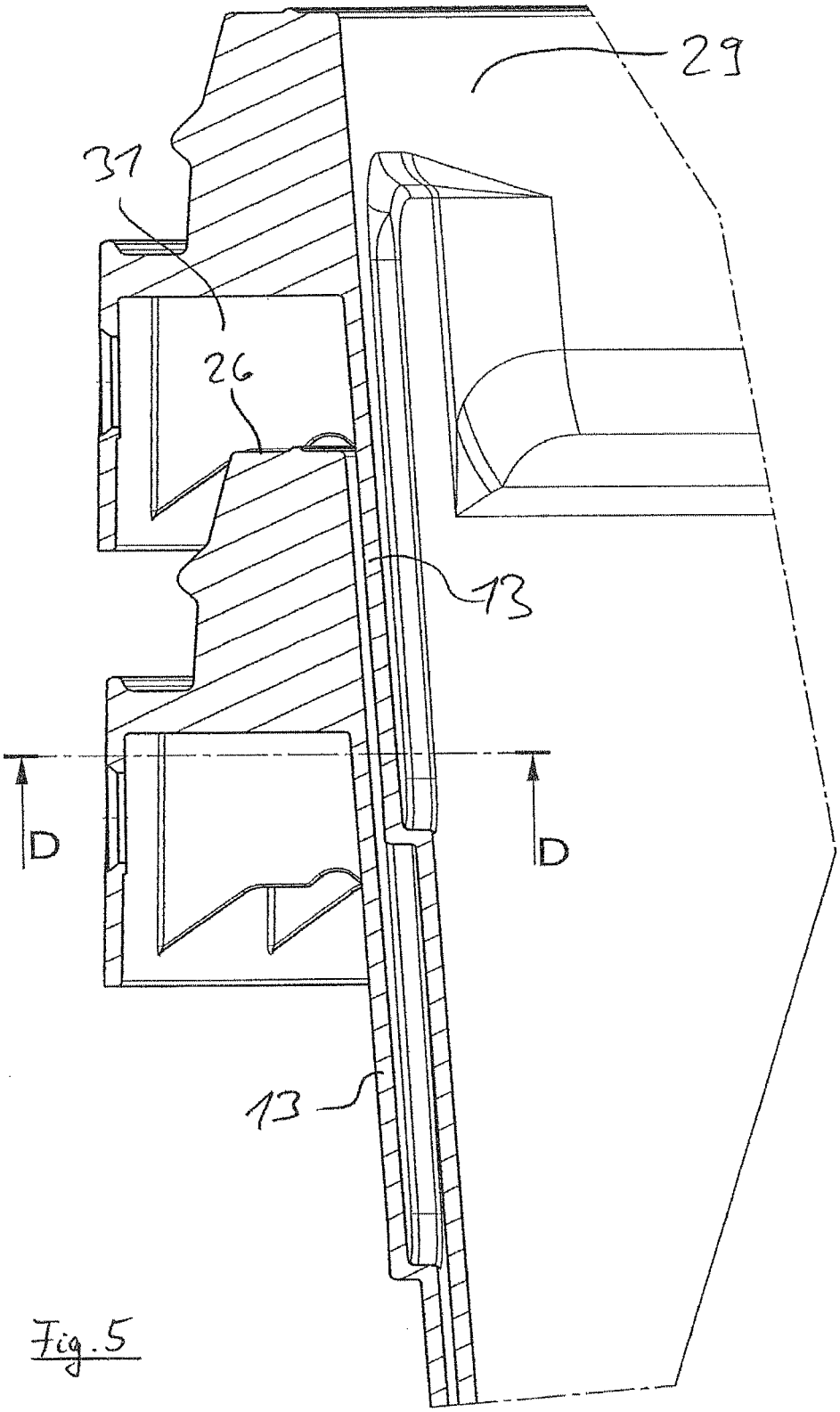
FIG. 5 shows the subject matter according to FIG. 2 in a stacked view.

According to the view in FIG. 5, two containers are stacked by means of the ribs or webs 31 which extend between the two legs of the n-shaped edge region.

The sealing edge 26 is used as a contact surface for the ribs 31. It is also apparent from FIG. 5 that the anti-twist locks 13 are formed by outwardly turned projections which merge into the topmost side edge 29.

Figure 6:
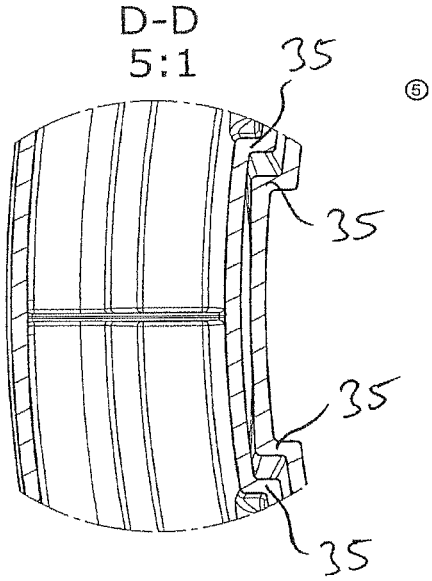
FIG. 6 shows the subject matter according to FIG. 5 along D-D.

According to FIG. 6, the contact edges 35 form locks which prevent twisting in the stack, since the anti-twist locks partially engage with one another in the stack.

Figure 7:
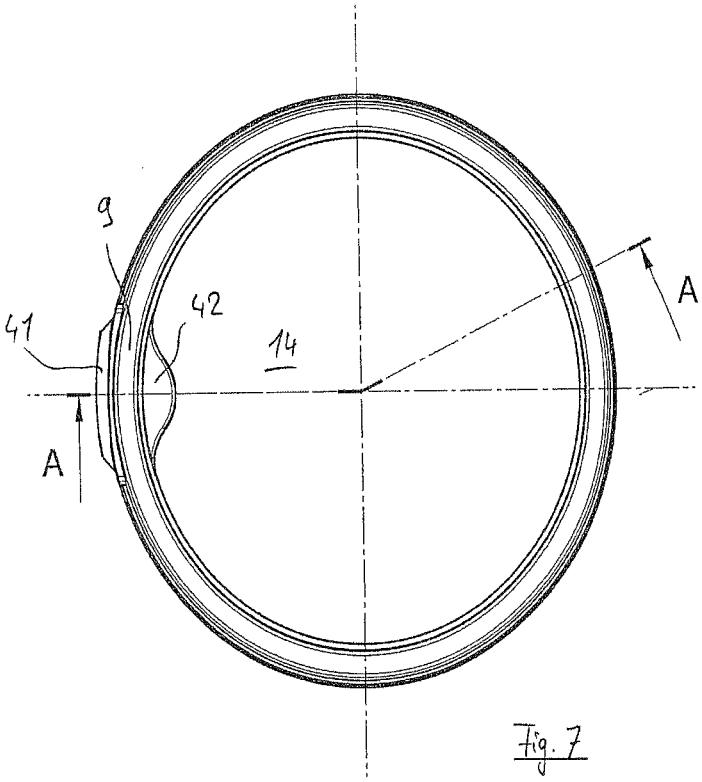
FIG. 7 shows a lid of the subject matter according to the invention in a top view.
Figure 8:
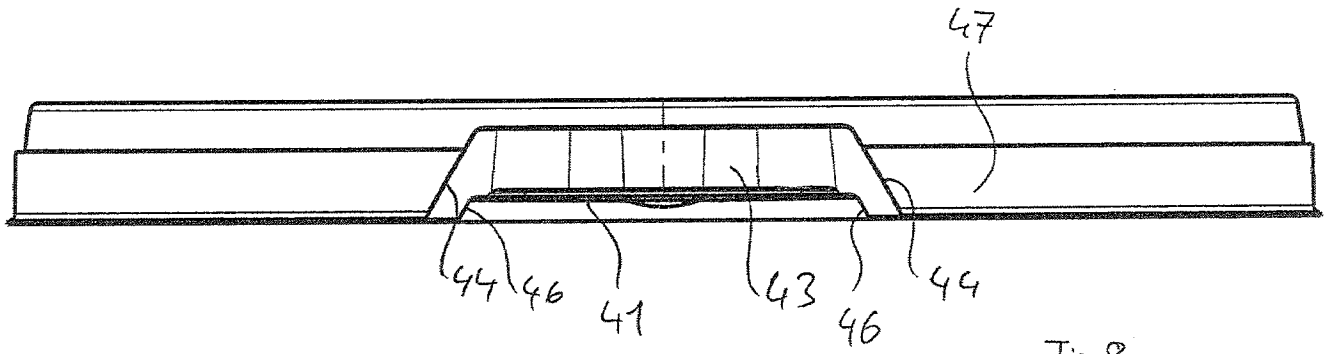
FIG. 8 shows the subject matter according to FIG. 7 in a front view.

The lid according to FIG. 7 has a gripping lug 41 which in the circumferential direction is accompanied by a protrusion or protuberance 42, situated in the lid surface, on the inwardly facing side of the edge 9 of the lid. Viewed in the circumferential direction, the protuberance is thus situated next to the gripping lug. A label provided with a recess corresponding to the protrusion 42 may thus be situated in the lid surface 14. This label is then oriented toward the protrusion 42, and correspondingly, the gripping lug 41. Together with a tamper-evident tab situated in the circumferential direction, directly between the two attachment points 10, such a design of a container according to the invention results in a symmetrical configuration of the lid and container, including the associated label.

In the closed position of the container, the gripping lug 41 is covered by the tamper-evident tab 6 after filling and before the first opening. For this purpose, the tamper-evident tab 6 is flared outwardly.

The container itself has an anti-twist lock 43 on the lid side which includes locking edges 44 on the side which cooperate with inner edges 46 of another lid in the stack. The anti-twist lock on the lid side may be formed by an edge region of an outer edge 47 of the lid, which may be offset downwardly or also upwardly. In the present case, the region is an upwardly offset region 43. The same as for the lateral contact edges 35 of the anti-twist lock on the container side, the edges 46 and 44 of the anti-twist lock are angled toward one another on the lid side 43.

Figure 9:
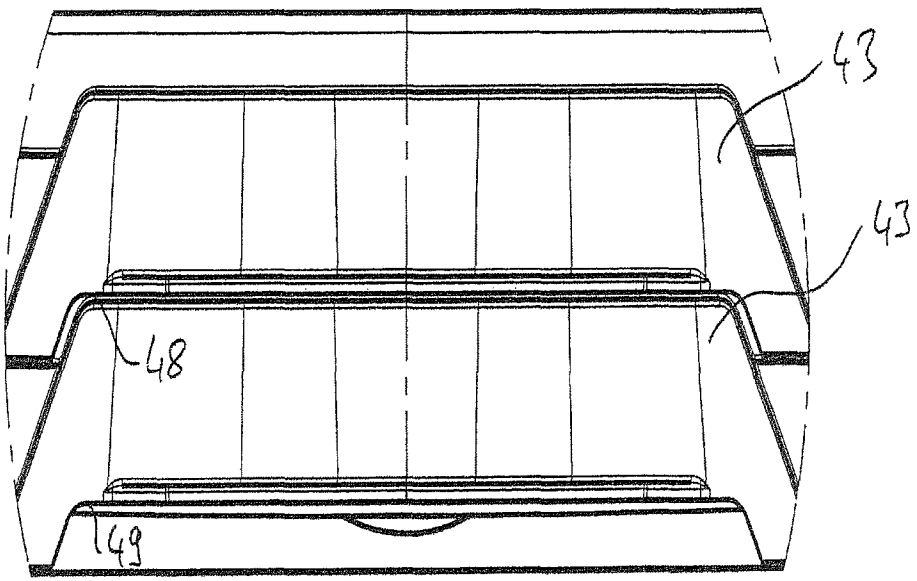
FIG. 9 shows the subject matter according to FIG. 8 in a stacked view.
Figure 10:
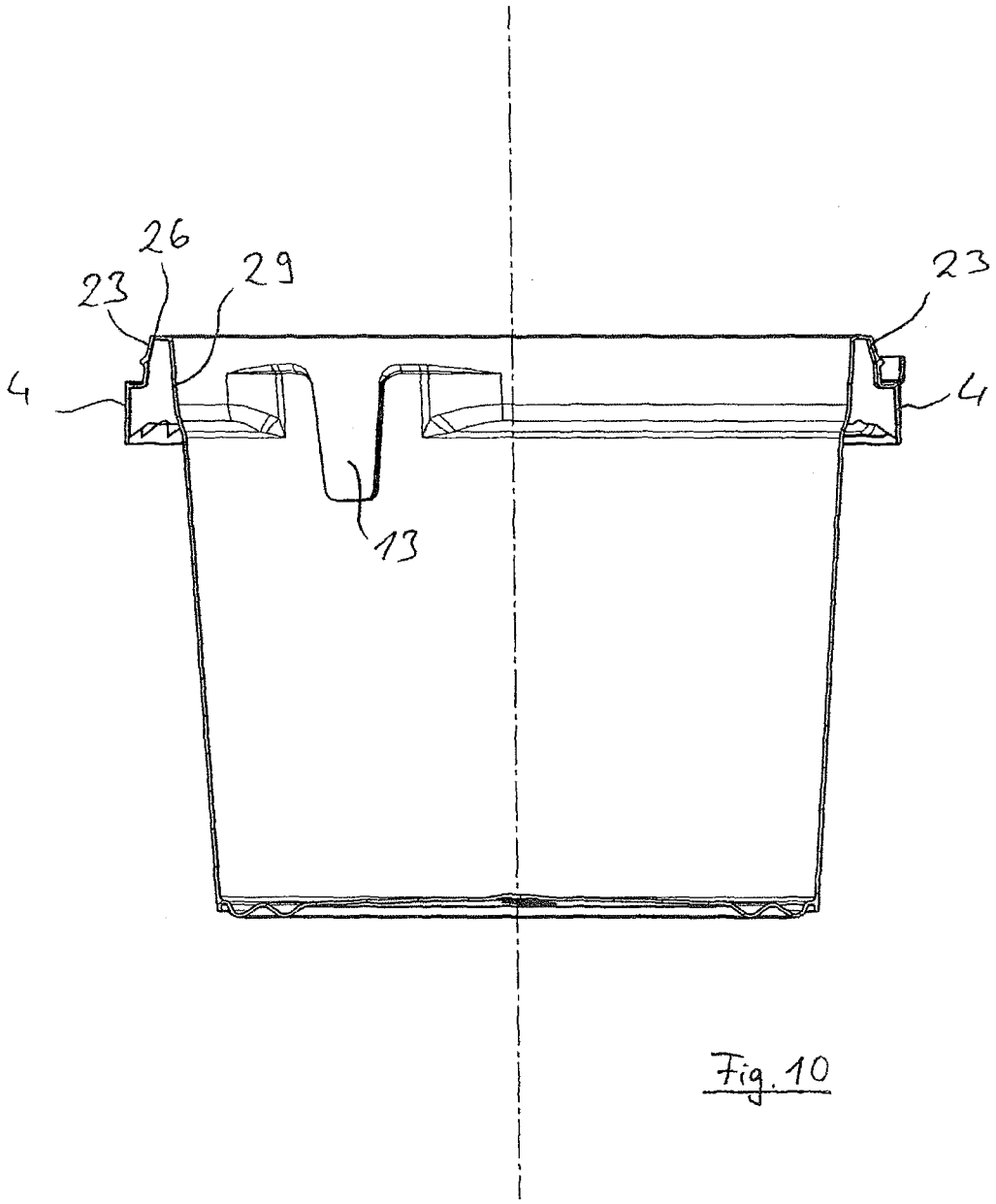
FIG. 10 shows a vertical section of the subject matter according to FIG. 2, which compared to the view according to FIG. 2 is rotated about a longitudinal center axis.

The internesting of two lids 2 via their respective anti-twist locks 43 is shown once again in greater detail in FIG. 9. The distances between the upper and lower edges 48 and 49 thus also correspond, in terms of distance, to the stack height of the lids.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

The invention claimed is:

1. A packaging container for keeping hot, fillable foods, in particular food packaging made of plastic, comprising:

a lid;

a container;

a tamper-evident closure, situated on a skirt which extends next to a side wall;

a tamper-evident tab;

the container having a holding space which is delimited by the side wall;

the lid having a snap-on element being fixable at the top container edge;

the container having an anti-twist lock such that a plurality of the containers may be fixed in a stack in the peripheral position before filling;

the anti-twist lock of the container being formed by an offset which tapers downwardly in a side wall in the direction of a contact surface, wherein the anti-twist lock is formed by an outward protrusion of the sidewall that is continuous with the sidewall;

the anti-twist lock having two contact edges in the circumferential direction; and an upper sealable container edge together with the adjoining side wall and the outer skirt forming an n-shaped profile, the two legs of the n-shaped profile being connected to one another via support ribs, wherein the upper sealable container edge forms a contact surface for ribs of a second, identical container when said second, identical container is nested with said container, and further wherein said distance between said upper sealable container edge and a bottom of said ribs defines a vertical distance between said nested container and second, identical container.

2. The packaging container according to claim 1, wherein the anti-twist lock tapers upwardly into an outwardly flared region of the side wall.

3. The packaging container according to claim 1, wherein the anti-twist lock, at its lower end, forms a shoulder having an edge that is parallel to a lower contact plane.

4. The packaging container according to claim 1 further comprising container being designed as a pail having a handle being fastened to two handle joints; and the anti-twist lock, when viewed in the circumferential direction, is situated next to a handle joint.

5. The packaging container according to claim 1, wherein the lid has an anti-twist lock on the lid side, such that a plurality of lids in the stack may be fixed in the peripheral position before filling.

6. The packaging container according to claim 5, wherein the anti-twist lock on the lid side is formed by a region, located in the outer edge of the lid and offset upwardly with respect to the rest of the outer edge, having locking edges on the side.

7. The packaging container according to claim 6, wherein the locking edges are angled relative to one another in a front view, and the anti-twist lock on the lid side has upper and lower contact edges whose vertical spacing from one another in particular corresponds to a stacking height of the lid.

8. The packaging container according to claim 5, wherein the anti-twist lock on the lid side has a gripping lug which, in a closed position of the container, is covered by the tamper-evident tab after filling and before the first opening by a user.

9. The packaging container according to claim 1, wherein lid has a protuberance, situated in the lid surface, as a positioning aid for a label to be placed on a lid surface.

10. The packaging container according to claim 9, wherein the protuberance, viewed along the periphery, is situated next to a gripping lug.

11. The packaging container according to claim 1 further comprising a container base, said container base being closed and having at least two contact elements in the radial direction, said contact elements being separated by an elevated region that is raised relative to the contact surface.

12. The packaging container according to claim 11, wherein the contact elements in a top view preferably have a substantially circular circumferential design.

13. The packaging container according to claim 11, wherein viewed in the vertical section, the two contact elements and the elevated region together are at least substantially wave-shaped.

14. The packaging container according to claim 13, wherein viewed from the top, the contact elements and the elevated region cover less than one-half the surface area of the container base.

15. The packaging container of claim 11 wherein the elevated region is designed as an additional anti-twist lock.

16. The packaging container according to claim 1, wherein the tamper-evident tab is externally attached to the n-shaped profile.

17. The packaging container according to claim 1, wherein the tamper-evident tab is delimited by two side edge tabs, pointing upwardly from the remaining outer edge of the container, which are located farther out, relative to a longitudinal center axis of the container, than the adjacent regions of the tamper-evident tab.

* * * * *